US006537117B1

(12) United States Patent
Larson et al.

(10) Patent No.: US 6,537,117 B1
(45) Date of Patent: Mar. 25, 2003

(54) ERGONOMIC PADDLE GRIP

(76) Inventors: Brad J. Larson, 1950 E. 3200 North, North Logan, UT (US) 84341; Lance F. Gunnell, 1320 N. 600 East, Suite 2, Logan, UT (US) 84341

( * ) Notice: Subject to any disclaimer, the term of this patent is extended or adjusted under 35 U.S.C. 154(b) by 0 days.

(21) Appl. No.: 09/790,172

(22) Filed: Feb. 21, 2001

(51) Int. Cl.[7] ..... B63H 16/04
(52) U.S. Cl. ..... 440/101; 416/70 R
(58) Field of Search ..... 16/430, DIG. 12; 440/101; 416/70 R, 74

(56) References Cited

U.S. PATENT DOCUMENTS

| | | | | | |
|---|---|---|---|---|---|
| 2,566,023 | A | * | 8/1951 | Gagnon | 416/74 |
| 2,913,727 | A | * | 11/1959 | Smith | 416/72 |
| 3,269,399 | A | * | 8/1966 | Smith | 135/72 |
| 3,517,678 | A | * | 6/1970 | Gilsdorf | 135/72 |
| 3,751,094 | A | * | 8/1973 | Bohler | 16/426 |
| 4,673,361 | A | * | 6/1987 | Harvey | 416/72 |
| 4,701,142 | A | * | 10/1987 | Merritt | 16/426 |
| 5,606,772 | A | * | 3/1997 | Ilic | 15/145 |
| 5,649,845 | A | * | 7/1997 | Fechtner | 441/56 |
| 6,022,255 | A | | 2/2000 | Lukanovich | 440/101 |
| 6,027,386 | A | | 2/2000 | Hains et al. | 440/101 |
| 6,027,387 | A | | 2/2000 | Allin | 440/104 |
| 6,065,421 | A | | 5/2000 | Haller et al. | 114/347 |
| 6,261,141 | B1 | * | 7/2001 | Heap | 440/101 |
| 6,328,617 | B1 | * | 12/2001 | Gunnell | 416/70 R |

FOREIGN PATENT DOCUMENTS

| | | | | |
|---|---|---|---|---|
| DE | 807597 | * | 7/1949 | 416/70 |
| GB | 2 234 932 | * | 2/1991 | 440/101 |
| SU | 1525081 | * | 11/1989 | 440/101 |

OTHER PUBLICATIONS

Waterstick Performance Paddles; Waterstick Performance Products; pp. 1–3.

* cited by examiner

*Primary Examiner*—Sherman Basinger
(74) *Attorney, Agent, or Firm*—Madson & Metcalf

(57) ABSTRACT

The present invention relates to an ergonomic kayak paddle. The paddle has a shaft with a longitudinal axis and with a first end and second end. The shaft is adjustable between a first length and a second length. At least one grip is on the shaft at a point intermediate between the first and second ends of the shaft. The grip is contoured to a user's hand, but does not provide profiles for the user's fingers. The grip may be angled outwardly from the longitudinal axis of the shaft at an angle ranging from about 10° to about 30°. An adjuster positioned within the grip allows the angle of the grip to the handle to be adjusted.

26 Claims, 8 Drawing Sheets

ERGONOMIC PADDLE GRIP

1. FIELD OF THE INVENTION

The present invention relates to the ergonomic grips. More specifically the present invention relates to ergonomic grips for use in sporting equipment.

2. TECHNICAL BACKGROUND

Kayaking is a growing sport in the United States and throughout the world. There are a number of different types of kayaking and the boats and paddles associated therewith are designed for the particular type of activity engaged in. Thus, there are both calm water kayaks and white water kayaks along with sea or ocean kayak. For centuries, Eskimos have paddled Arctic waterways to hunt and fish in kayaks, a type of canoe built from skins stretched over a frame. Today's high-tech versions of the kayak, made from plastic, Kevlar and fiberglass, are still decked with a cockpit for the rider, who propels the boat with a double-bladed paddle.

The sport of kayaking is growing rapidly in popularity. It is believed to be second only to snowboarding in growth. Driving that growth is a recent revolution in kayak hull design that has made doing tricks, such as wave surfing, squirts and spins, much easier. There are an estimated 1.3 million white water kayakers in the United States, 400,000 of whom can be considered "enthusiasts." One of the reasons for the increasing popularity of the sport it that a kayaker can experience solitude and wilderness on the one hand and excitement on the other.

Recent developments in kayaks have fueled the increased interest in the sport. In some instances, kayak builders have followed innovations in surfboards to come up with boats that "plane," riding on top of the water instead of in the water.

As kayaks have improved and developed, additional sports and activities are possible. Where traditional kayakers simply traveled a waterway, modem kayakers maneuver and perform tricks to improve and demonstrate their skills. To promote these types of activities, kayak rodeos are springing up around the country. Many of today's kayaks are specifically designed to be used in rodeos. These boats are generally small and sharply angled. These boats, however, are not ideally suited for river running in that they are too slow and do not track well. Thus, "park and play" is a growing phenomenon, while down-river running is declining in popularity. This marks a radical departure from the roots of these sports, which were born from the need to get from one place to another. Thus, innovation is allowing more people to get into kayaking and to do different things on a river.

As kayak's have evolved allowing the sport to evolve, there is also a need for improvements in paddle design. Generally, a kayak paddle is comprised of an aluminum or wood shaft. The shaft is generally approximately 1.25 inches in diameter. This diameter allows the user to directly grip the paddle. There are generally no specific grips or other structures to allow the user to securely hold the paddle. At times, the user may modify his own paddles by adding tape or other wrappings to make the paddle more comfortable and usable.

Generally, however, the development and improvement of the paddle has not kept pace with development in the kayaks themselves. In particular, kayak paddles have not been designed to address the injury that can be associated with kayaking. New designs in paddles have tried to address the risk of injury to the shoulder, elbow, and wrist. Many manufacturers state that their product is "ergonomically designed," but provide little information on how the products are ergonomic. Ergonomics come from the Greek words "ergos," meaning work, and "nomos," meaning knowledge. Ergonomics involves adapting a tool or other object to the needs of the worker or user, rather than trying to make the worker adjust to the tool. However, little information is available about how to design an ergonomically correct grip, especially a paddle grip.

A major motivation for ergonomic design is the improved performance and health of the user of the tool. In the field of kayaking, fatigued or uncomfortable kayakers are less capable of maintaining safe performance of their task. If they are required to perform repeatedly and beyond their physical capabilities, breakdown and injury will recur. The resulting injury is what is commonly classified as a cumulative trauma disorder. Injuries that occur with poor ergonomic design are usually disorders of wear and tear, including overuse syndromes, repetitive strain injuries, musculoskeletal injuries, and compressive neuropathies. Injuries common to kayaking include carpal tunnel syndrome, wrist tendinitis, medial or lateral elbow epicondylitis, and rotator cuff muscle strains and tears. Cumulative nature of these injuries indicates the injury occurs over a period of weeks, months, or even years, or as the result of repeated stresses on a particular musculoskeletal area. Each repetition of an activity can produce a small trauma to the tissues and joints of the body.

Although the human body has enormous self-repair abilities, continued exposure to stress can outweigh these abilities, which then results in injury. Factors such as force strength, high repetition, awkward posture, reduced recovery time, and environmental factors like vibration and cold exposure can lead to injury over time. All of these factors can produce injury alone, but the incident of injury is increased when these risk factors are combined. The simple activities of repetitive gripping, twisting, reaching, and moving can be hazardous when repeated numerous times over an extended period.

Static overloading results from muscles being subjected to too much stress over a period of time. The small muscles of the hand and the extensor muscles of the wrist are most vulnerable to static overloading. These muscles stabilize the hand during forceful use and balance the extensor tendons during fine manipulation. Sustained contraction can result in tendinitis, especially about the elbows. Spreading the load over as many muscle groups as possible will help to avoid overloading the smaller muscle groups. In the case of kayaking, inappropriate paddle design can increase the risk of injury to the hand, arms, shoulders, and back. Because kayaking involves repetitive use of a hand tool, namely the kayak paddle, a kayak paddle can be designed according to ergonomic standards.

Poor paddle design can overstress the muscles, resulting in fatigue and unnecessary dissipation of energy for paddle retention. When a paddle does not properly fit in a user's hand or becomes wet and slippery, a user may exert a large force to grip the paddle. Such power gripping requires force greater than 50 pounds per hand and can be detrimental. If the wrist is also used to exert the force, a grip force of 32 pounds is acceptable. Because of their lack of bony and muscular protection, the neurovascular bundles of the fingers are very susceptible to contact stresses. Handles that are profiled for the fingers and lack of protective cushioning make these areas susceptible to trauma.

Another consideration in designing an ergonomic tool such as a kayak paddle is maintaining adequate blood flow in the muscles. During muscular contraction, blood flow can be impeded to levels as low as 40% of the maximal voluntary contraction for the muscle. Static muscle contractions reduce the blood flow as long as the contraction is maintained. Metabolites accumulate and oxygen to the muscle can be quickly depleted, resulting in fatigue. Muscle fatigue, defined as a decreased force generating capacity, develops gradually during exercise and is distinct from exhaustion, which occurs when the hard force or exercise intensity can no longer be maintained.

The position of the forearm and wrist during paddling are also important. It is well known that when the wrist deviates from the neutral the strength of a user's grip is reduced thereby requiring the user to exert a greater force to hold the handle. Different postures appear to result in compressive and shearing forces on the tendons, which may be transferred to adjacent nerves. The eventual consequence of this is a development of tendinitis, joint strain, and peripheral neuropathies such as carpal tunnel syndrome.

Moreover, kayakers are frequently exposed to environmental conditions, such as cold and vibration, which have been shown to cause problems as well. Cold handles can result in vasoconstriction and decreased blood flow during forceful gripping, thereby increasing the effort required. Vibration has been shown to contribute to compressive neuropathies and tenosynovitis.

Conventional kayak paddles are not ergonomically designed. These design deficiencies can lead to static overload of muscles, joints, tendons, and ligaments. Over time, serious injury can occur to the bones and muscles of a kayaker. Additionally, the use of conventional kayak paddles can result in vasoconstriction and decreased blood flow to the hands thereby increasing the possibility of injury. The poor paddle design can cause damaging compressive forces. Because kayakers are confined to wet and cold environments the chances of injury are high.

Therefore, it would be advancement in the art to provide an ergonomic kayak paddle. It would be a further advancement to provide a kayak paddle that could relieve damaging stress. It would be a further advancement if the kayak paddle reduced vasoconstriction. It would be an additional advancement in the art to provide a kayak paddle that reduced compressive forces. It would be a further advancement if the ergonomic kayak paddle could reduce the overall chance of injury to the kayaker. Such a paddle is disclosed and claimed herein.

3. BRIEF SUMMARY OF THE INVENTION

The present invention relates to an ergonomic handle for use with a tool such as a kayak paddle. In general, the handle of the present invention may be used with a kayak paddle, however other paddles, tools, and the like may be designed using the ergonomic characteristics of the handle of the present invention. The handle has at least one grip which is disposed about the shaft of the handle. The grip has a gripping surface for accommodating the hand of a user. The shaft of the handle has a longitudinal axis running from a first end of the shaft to a second end of the shaft.

The paddle grip may be designed to maintain the user's wrists in a neutral position during the motion of the paddle. The neutral position is defined by alignment of the third metacarpal with the radius of a user. When a straight shaft is grasped, these bones are not aligned. With the wrist out of the neutral position, the user's ability to grip the paddle may be lessened. The user may compensate for this reduction with other muscles and bones, which may lead to an injury. Angling the grip away from the shaft allows the user's wrist to be maintained in the neutral position. The grip may therefore be constructed such that a portion of the gripping surface designated the upper surface of the grip, is angled away from the shaft at an angle ranging from about 10° to about 30°. In certain configurations, the angle is between about 12° to about 28°. Alternatively the angle may be between about 22° and about 26°. In one presently preferred embodiment the angle is about 24°.

A kayak paddle may be provided with a grip designed to ergonomic standards. One consideration for the grip is the positioning of the wrist and forearm of the user in a neutral position while holding the handle. When the upper surface of the grip is angled away from the shaft, the wrist and forearm may be positioned in a more neutral position when compared to a straight shaft. The grip may also be contoured to the hand of a user. The contour allows the grasping force to be spread evenly along the hand. However, when channels for the user's fingers are provided, the grip may not properly fit all users causing fatigue and stress on the user's hand. The grip may have a textured surface for engaging the user's hand. The textured surface may allow for the distribution of stress throughout the hand and allow for better blood circulation.

The grip may be sized to generally fit within the palm of a user's hand. A grip length of about 10 to about 12 centimeters will allow the grip to fit within the palm of the hand of most users. The diameter of the grip may also be sized to fit within the palm of a user. Generally, a diameter that is about 1 centimeter smaller than a user's inside grip is sufficient. The shaft may have a diameter in the range of from about 0.75 to 1.00 inch which accommodates correct sizing of the paddle grip.

Additional ergonomics may be achieved by sizing the length of the shaft of the paddle to the user. Thus, a larger person may require a longer paddle to reduce the amount of leaning and twisting required to place the paddle in the water. A shorter person may also require a somewhat shorter shaft to position the paddle in the water without undue stress. When the paddle is used by more than one kayaker, the paddle may be designed with an adjustable shaft. Thus, the shaft can be provided with an adjustment mechanism to adjust its length to properly fit a user of any size.

Often a paddle will be used by more than one user. Thus, providing a grip that can be adjusted to fit more than one user is beneficial. The grip may be configured to allow for the adjustment of the angle of the grip with respect to the shaft. An adjuster may be positioned within the grip to change the angle of the grip. Such adjusters may include one or more set pins disposed in one end of the grip. Other adjusters may include a ratchet device or shunts positioned between the grip and the shaft.

Another commonly associated problem that can lead to injury is the tendency of a user to forcefully and continuously grip the paddle for an extended period of time. Often a user will kayak for hours at a time. The paddle must be continuously gripped even when not paddling to prevent the kayaker from dropping the paddle in the water. A hand strap may be connected to the in shaft allowing for a user to loosen his hold on the paddle without risking dropping the paddle.

Another consideration in the ergonomic paddle is the relative placement of the hands on the paddle. To maintain the position of the hands in an ergonomically correct position, the grips may be attached to the shaft by a releasable attachment mechanism such that the grip may be rotated about the longitudinal axis of the shaft. Such releasable attachment mechanisms may include, but are not limited to, a set screw and a clamp.

The ergonomic kayak paddle of the present invention provides at least one grip which allows the user to grasp the paddle. The grip is angled such that the wrist and forearm of the user is maintained in the neutral position. The grips can be rotated and adjusted to customize the ergonomic fit to a particular user. Moreover, the length of the paddle may be adjusted to accommodate multiple users sharing the kayak paddle. These and other features, and advantages of the present invention will become more fully apparent from the following description and appended claims, or may be learned by the practice of the invention as set forth hereinafter.

4. DESCRIPTION OF THE DRAWINGS

In order that the manner in which the advantages and features of the invention are obtained, a more particular description of the invention summarized above will be rendered by reference to the appended drawings. These drawings only provide selected embodiments of the invention and are not therefore to be considered limiting of the scope. The invention will be described and explain with additional specificity and detail through the use of the accompanying drawings.

5. DETAILED DESCRIPTION OF THE INVENTION

The present invention can be better understood with reference to the drawings where like parts are designated with like numerals throughout. The present invention relates to a ergonomic handle and more specifically to an ergonomic paddle for use in kayaking. X-ray photography was used to study the position of a user's hand while holding a shaft to determine the most ergonomic configuration for the handle.

Figure 1:
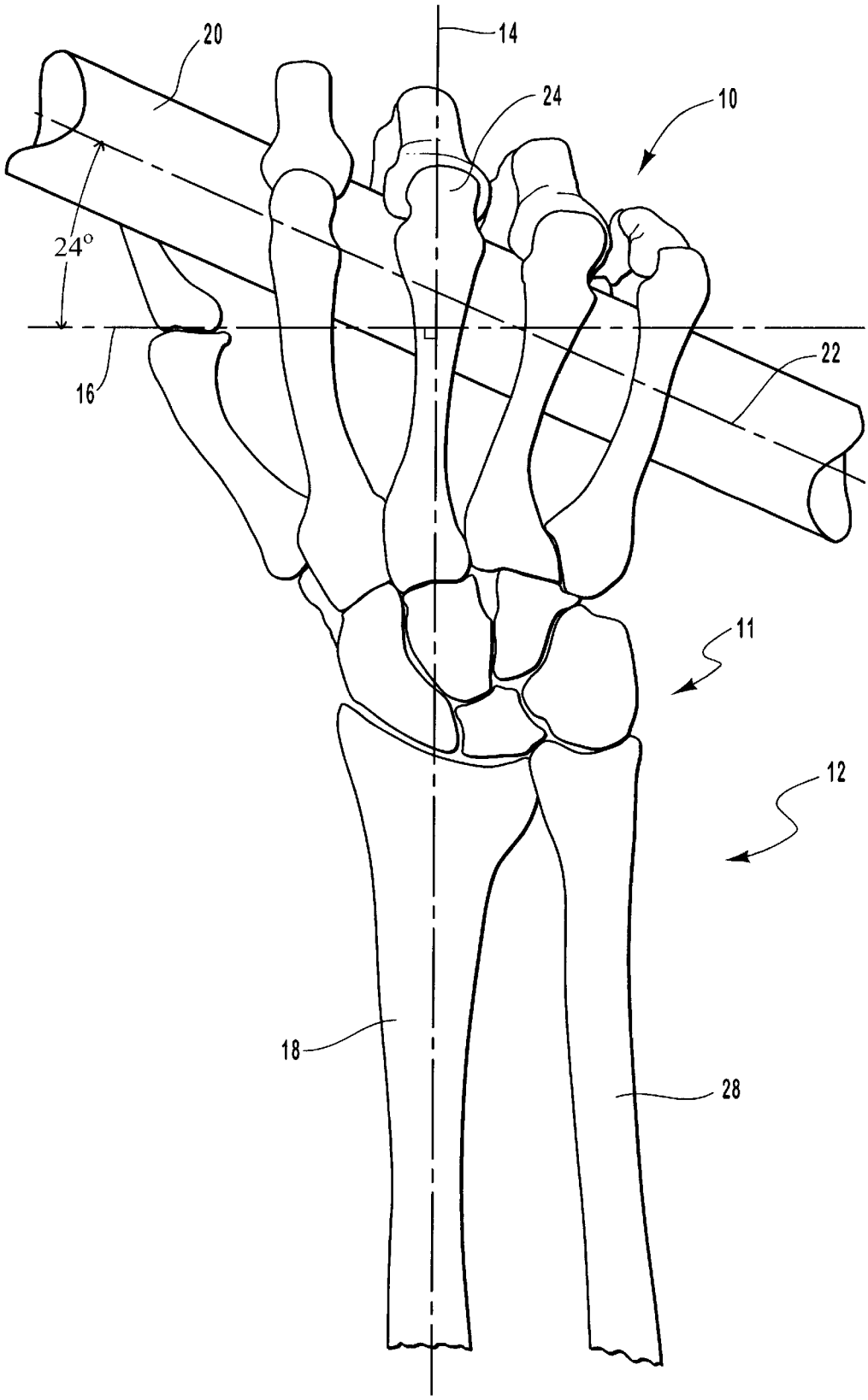
FIG. 1 is a perspective view of the bones of a hand and forearm with the grasping a shaft angled at about 24° with respect to the horizontal. This drawing of bones and shaft is derived from an X-ray photograph.

Referring now to FIG. 1, a drawing taken from an X-ray, illustrates a perspective view of a hand 10 and forearm 12. A vertical line 14 is drawn from approximately the center of the radius 18 into the hand 10. A horizontal line 16 is drawn perpendicular to the vertical line 14. The hand 10 is grasping a shaft 20. The shaft 20 has a longitudinal axis 22 which is angled outwardly from horizontal line 16 at about 24°. With the shaft 20 positioned at about 24° from the horizontal line 16, the vertical line 14 runs from the center of the radius 18 through the center of the third metacarpal bone 24. The vertical line 14 is approximately parallel to the third metacarpal bone 24. The alignment of the radius 18 and third metacarpal 24 indicate that the wrist 11 and forearm 12 are held in a neutral position.

Figure 2:
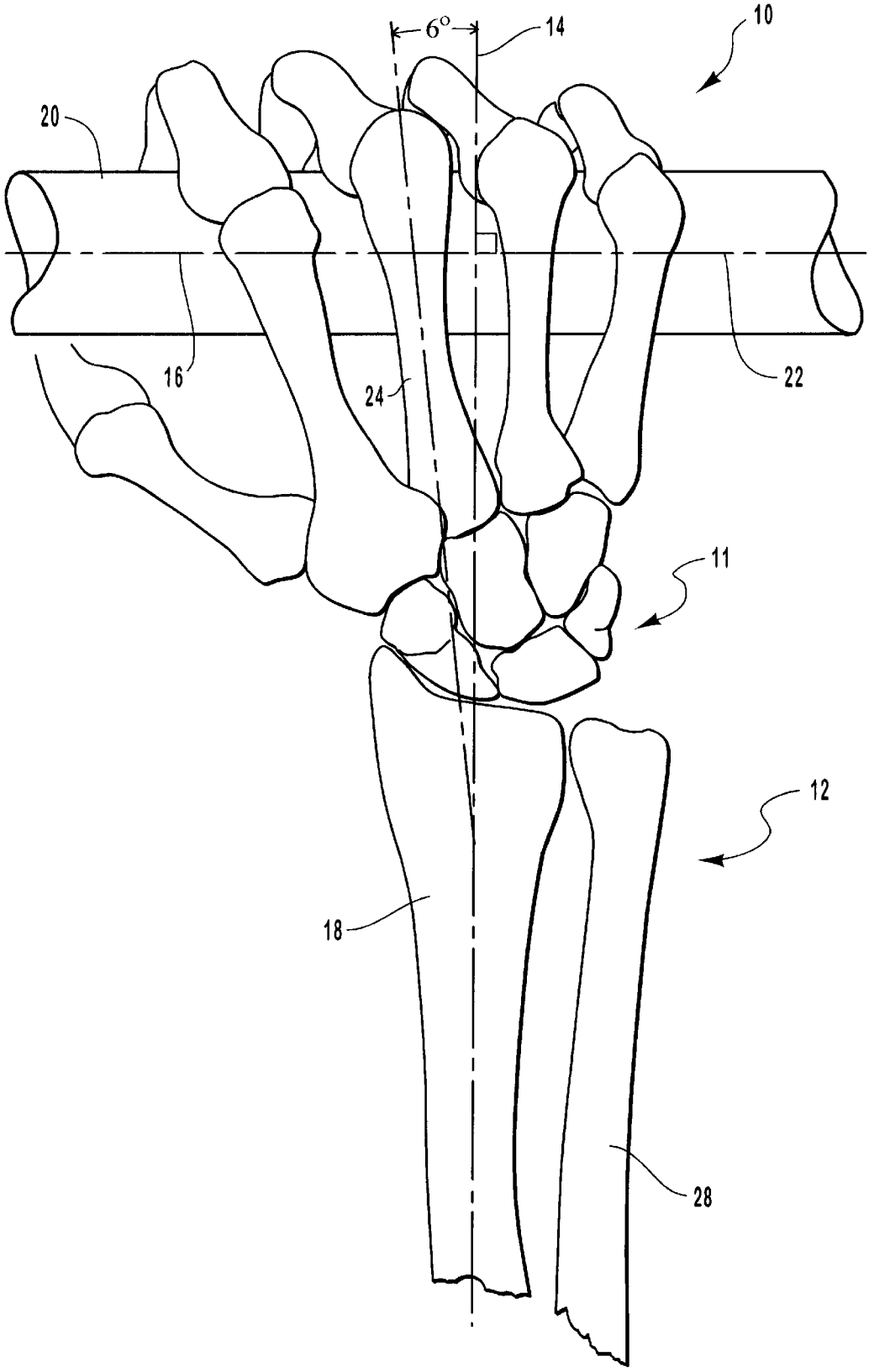
FIG. 2 is a perspective view of the bones of a hand and forearm with the hand grasping a straight shaft. This drawing of bones and shaft is derived from an X-ray photograph.

Referring now to FIG. 2, a subject holds a straight shaft 20 with both hands, such as the shaft 20 of a standard kayak paddle. The shaft 20 is held while the subject maintains his elbows at a 90° angle with the palms down. This is the position in which one would ordinarily hold a kayak paddle. A vertical line 14 is drawn from approximately the center of the radius 18 into the hand 10. A horizontal line 16 is drawn perpendicular to the vertical line 14. The shaft 20 has a longitudinal axis 22 which corresponds to the horizontal line 16. Unlike FIG. 1, the vertical line 14 is not parallel to the third metacarpal 24 indicating that the wrist 11 and forearm 12 are not in the neutral position. The third metacarpal 24 is angled towards the radius 18 side of the forearm 12 at 6°. Therefore, when one holds a straight shaft 20 in a horizontal position, the wrist 11 will significantly deviate radially from the neutral position. This deviation is not ergonomic and may result in injury.

Figure 3:
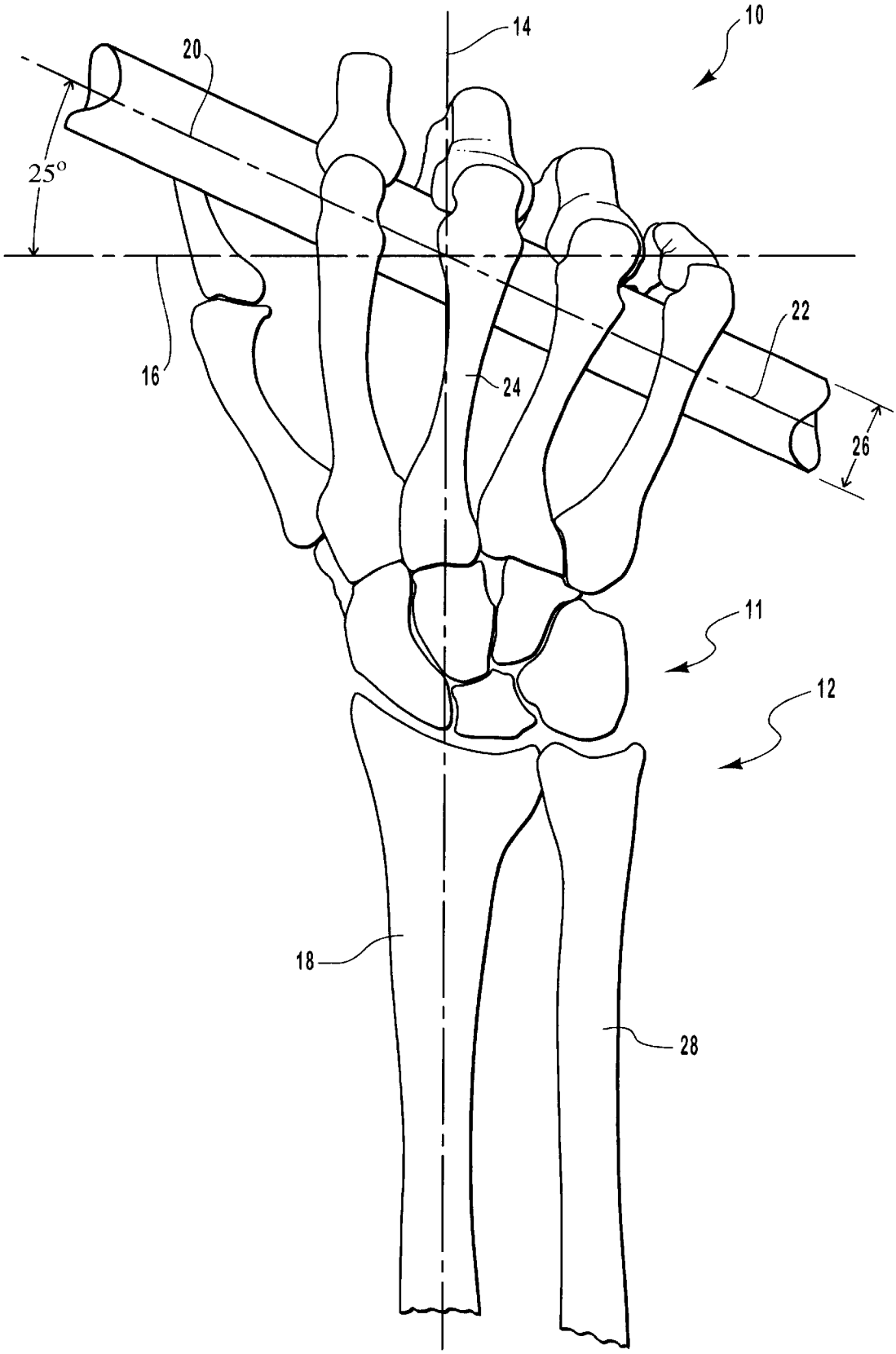
FIG. 3 is a perspective view of the bones of a hand and forearm with the hand grasping a ½ inch shaft angled at about 25° with respect to the horizontal. This drawing of bones and shaft is derived from an X-ray photograph.

Referring to FIGS. 3 though 5, a subject holds shafts 20 of different diameters at angled at approximately 24° from the horizontal. In each figure, the shaft 20 is held with the elbows at a 90° angle with the palms down as one would hold a kayak paddle.

In FIG. 3, the subject is holding a shaft 20 with a diameter 26 of about ½ inch. A vertical line 14 is drawn from approximately the center of the radius 18 into the hand 10. A horizontal line 16 is drawn perpendicular to the vertical line 14. The shaft 20 has a longitudinal axis 22 which is angled outwardly from horizontal line 16 at about 25°. With the shaft 20 positioned at about 25° from the horizontal line 16, the vertical line 14 runs from the center of the radius 18 and intersects with the third metacarpal bone 24. The alignment of the radius 18 and third metacarpal 24 indicate that the wrist 11 and forearm 12 are held in a neutral position. Thus, the ½ inch shaft 20 is held in the neutral position when the shaft 20 is angled outwardly from the horizontal line 16 at about 25°.

Figure 4:
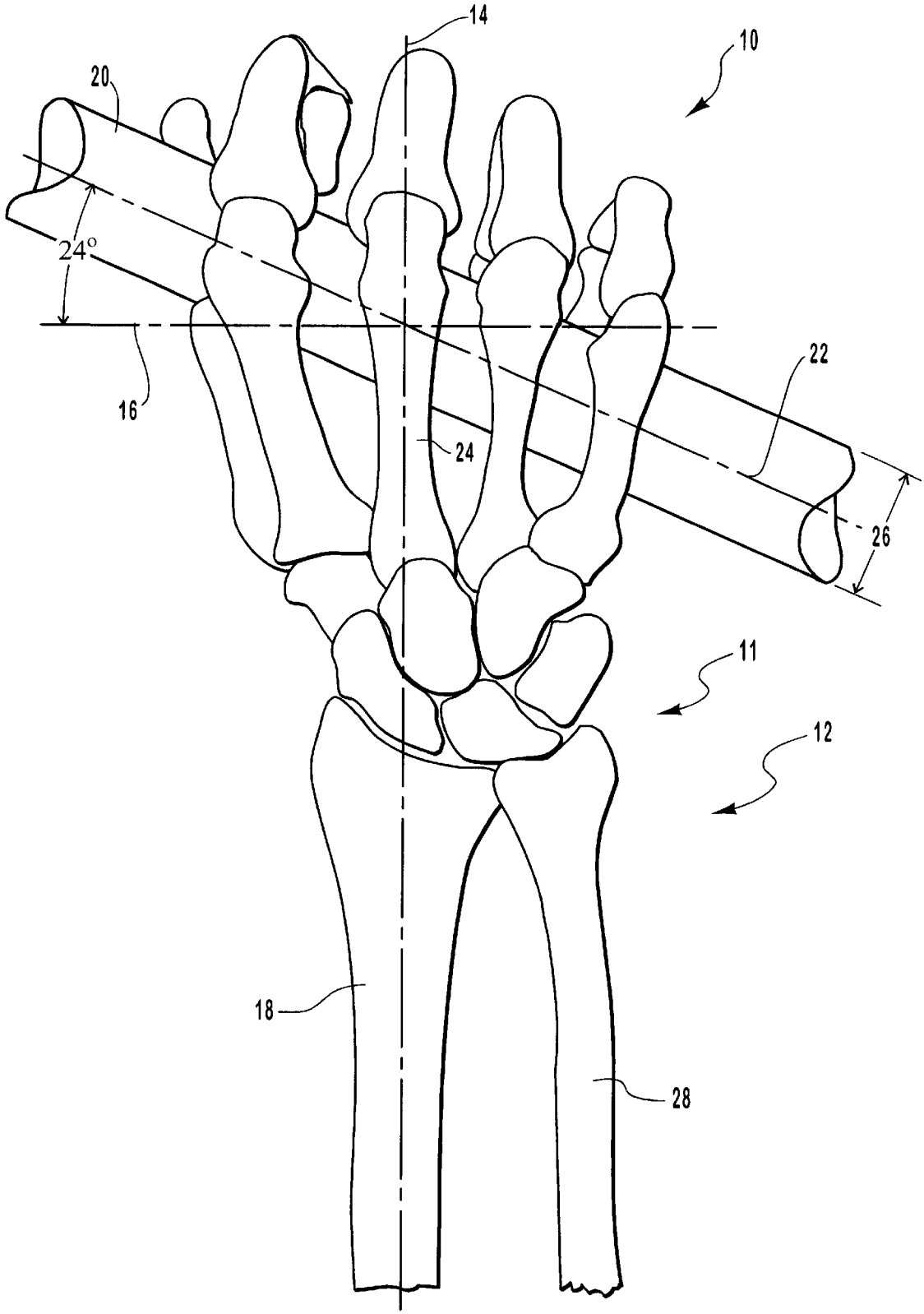
FIG. 4 is a perspective view of the bones of a hand and forearm with the hand grasping a 1½ inch shaft angled at about 24° with respect to the horizontal. This drawing of bones and shaft is derived from an X-ray photograph.

In FIG. 4, the subject is holding a shaft 20 with a diameter 26 of about 1¼ inches. A vertical line 14 is drawn from approximately the center of the radius 18 into the hand 10. A horizontal line 16 is drawn perpendicular to the vertical line 14. The shaft 20 has a longitudinal axis 22 which is angled outwardly from horizontal line 16 at about 24°. With the shaft 20 positioned at about 24° from the horizontal line 16, the vertical line 14 runs from the center of the radius 18 through the third metacarpal bone 24. The vertical line 14 is approximately parallel to the to the third metacarpal bone 24. With the 1¼ inch shaft 20 held at about 24°, the subject's third metacarpal and radius 18 are aligned indicating that the wrist 11 and forearm 12 are in the neutral position.

Figure 5:
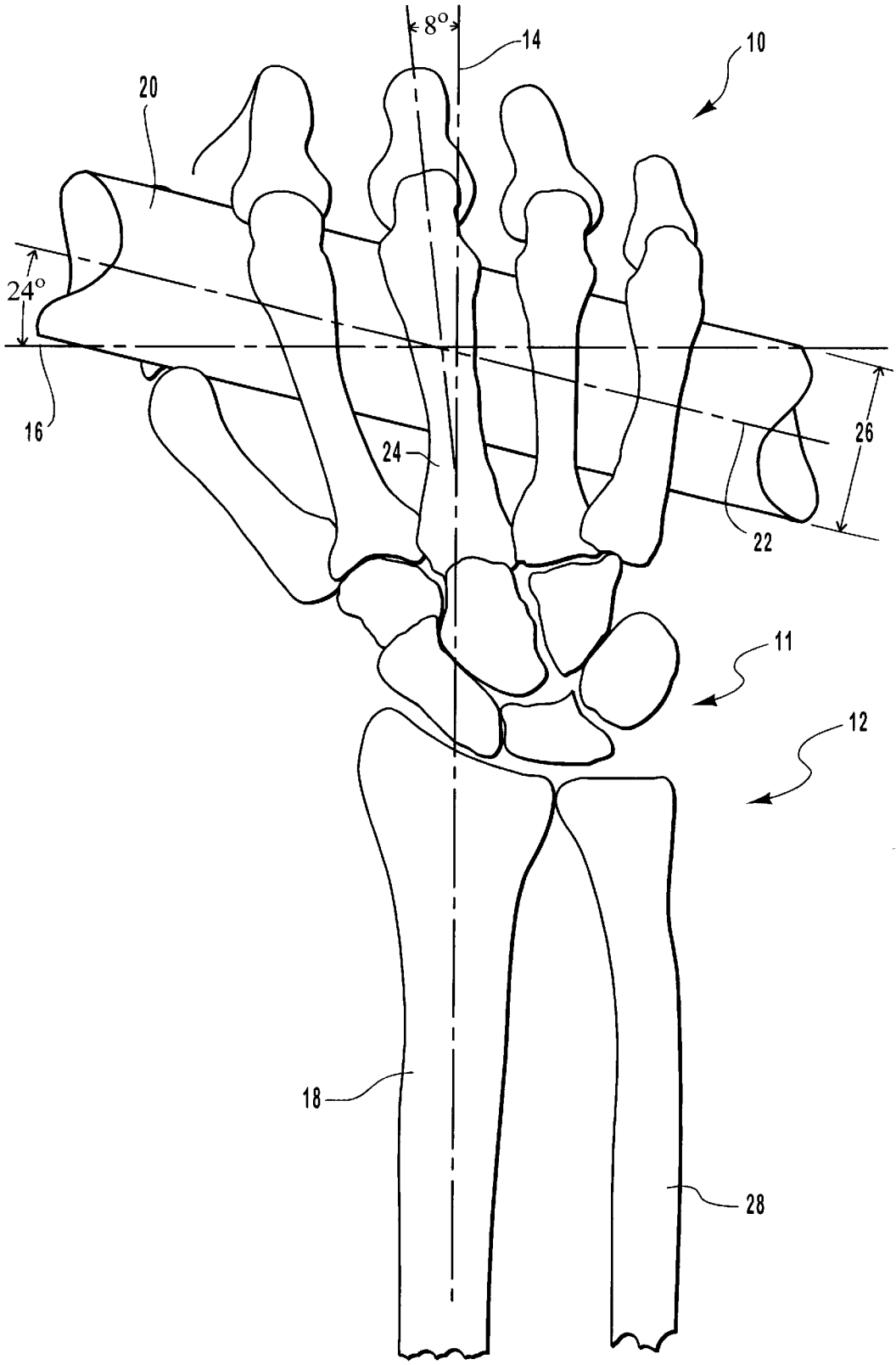
FIG. 5 is a perspective view of the bones of a hand and forearm with the hand grasping a 1¼ inch shaft angled at about 24° with respect to the horizontal. This drawing of bones and shaft is derived X-ray from an photograph.

In FIG. 5, the subject is holding a shaft 20 with a diameter 26 of about 1½ inches. A vertical line 14 is drawn from approximately the center of the radius 18 into the hand 10. A horizontal line 16 is drawn perpendicular to the vertical line 14. The shaft 20 has a longitudinal axis 22 which is angled outwardly from horizontal line 16 at about 24°. With the shaft 20 positioned at about 24° from the horizontal line 16, the vertical line 14 runs from the center of the radius 18 into the third metacarpal bone 24. The vertical line 14 is approximately parallel to the to the third metacarpal bone 24. The alignment of the radius 18 and third metacarpal 24 indicate that the wrist 11 and forearm 12 are held in a neutral position.

In each of FIGS. 3 though 5, the subject holds a shaft 20 angled outwardly from the horizontal line 16 at an angle of about 24°. In each instance the shaft 20 is held with the wrist 11 and forearm 12 in a neutral position. This is true even though the diameter 26 of the shafts in the figures varies from about ½ inch to about 1½ inches. Thus, the diameter 26 of the shaft 20 does not have a significant roll in the deviation of the wrist 11 and the forearm 12 from the neutral position. If one maintains the wrist 11 in the neutral position, and grabs a progressively larger diameter shaft 20, the wrist 11 and forearm 12 are still maintained in the neutral position at an angle of about 24°. However, as the diameter 26 of the shaft 20 is increased, the finger bones become progressively more deviated toward the ulnar side of the forearm 12. Thus, while the diameter 26 of the shaft 20 may not significantly affect the deviation of the wrist 11 and the forearm 12 from the neutral position, the diameter 26 can affect the grip strength.

Additional X-rays were taken with the subject holding a shaft 20 of about 1¼ inches in diameter 26. In each case, the shaft 20 was held with the elbows at a 90° angle with the palms down. The angle of the shaft 20 to the horizontal was varied from between about 14° to about 25°. It was found that as the angle of the shaft 20 outward from the horizontal was increased, the third metacarpal 24 and the radius 18 were increasingly aligned. This alignment was found to be maximal in the range from about 22° to about 24°.

Therefore in order to maintain the wrist 11 in a neutral position, the shaft 20 must be angled from the horizontal. A shaft 20 held in at an angle in the range from about 10° to about 30° can alleviate the stress placed on the wrist 11 and forearm 12 by a conventional kayak 11 paddle. However, an angle of about 12° to about 28° provides for better alignment of the radius 18 and third metacarpal 24. When the angle is in the range of about 22° to about 26° the radius 18 and third metacarpal 24 are generally aligned. An angle of about 24° provides for alignment of the radius 18 and third metacarpal 24.

Figure 6:
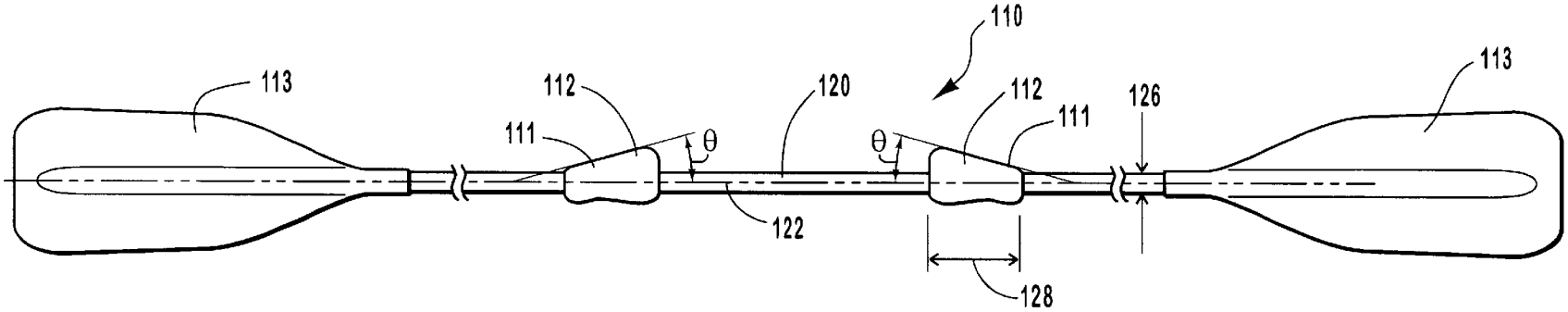
FIG. 6 is a perspective view of one embodiment of a kayak paddle of the present invention.

Referring to FIG. 6, a kayak paddle within the scope of the present invention is designated 110. The paddle 110 has at least one grip 112 and a shaft 120. A paddle blade 113 is positioned at each end of the shaft 120. The shaft 120 has a diameter 126 which can range from about 0.75 to about 1.00 inch to accommodate correct sizing of the paddle grip 112. The correct paddle grip 112 size can reduce stress on tendons and held to avoid stress to ligaments. In general, the size of any handle, such as grip 112, can influence the amount of force exerted to hold the handle. When a handle diameter 26 is too large, and the force is concentrated at the end of the fingers, the tendon forces can become two to three times greater than when the force is applied at the middle of the fingers. The flexor tendons then become inflamed and tendinitis develops. Conversely, with a small handle one cannot effectively apply force because of the disadvantage of the shortened extrinsic finger flexors. Small handles can also result in muscle overcompensation and strain to the small muscles of the hand. The grip 112 of the kayak paddle is about 1 cm smaller than the users inside grip diameter.

The grip 112 is configured distribute the grasping forces over as large an area as possible. The pressure of the grip 112 on the hand should be distributed over the fat pads of the hands. Thus the grip 112 is contoured to the palm of a user. However, placing form fitting finger grooves in the grip, can result in restricted blood flow to the hands. Improper blood flow may result in fatigue and stress to tendons and ligaments. Besides restricting blood flow, the edges of finger grooves can compress and irritate the small neurovascular bundles found on each side of the fingers. The contour of the grip 112 corresponds with the curve of the transverse palmar arch and the natural palmar curve of the fingers as they flex toward the palm.

The length 128 of the grip 112 on the shaft 120 of the kayak paddle 110 is also an important consideration in designing an ergonomic kayak paddle 110. The length 128 of the paddle should be long enough to evenly distribute the grasping force over the palm of the hand. A grip with a length in the range about 4 to about 5 inches or from about 10 to about 12 centimeters provides sufficient area to spread the grasping force over the palm of an average user. Additionally, about 0.5 inches in length of the gripping area 18 needs to be added if gloves are used.

The grip 112 is oriented in such a fashion to maintain the wrist 11 in a neutral position throughout the paddling motion. The neutral position is maintained by keeping the user's third metacarpal generally aligned with his radius. When a user grasps a straight rod such as the shaft 120 of the kayak paddle 110 with both hands, the wrist and fingers must rotate to firmly grip the shaft 120. However, if the front surface 111 of the grip 112 is angled outwardly from the longitudinal axis 122 of the shaft 120 at an angle θ, the user's third metacarpal is more generally aligned with his radius 18. An angle θ of the front surface 111 with the axis 122 ranging from about 10° to about 30° is sufficient to at least partially align the third metacarpal with the radius 18 and place the wrist 11 in the neutral position. Additionally, an angle θ ranging from about 12° to about 28° is more generally preferred. An angle θ in the range from about 22° to about 26° is presently preferred to accommodate most users of the handle. An angle θ of about 24° allows for maintaining the neutral position for a majority of users.

Figure 7:
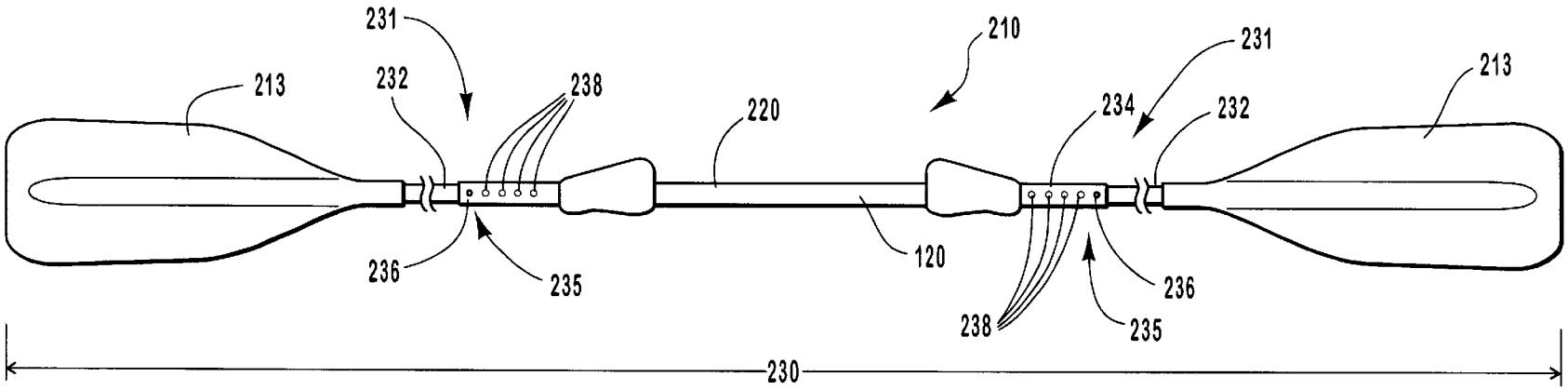
FIG. 7 is a perspective view of an alternative embodiment of the kayak paddle of the present invention.

Referring to FIG. 7, an alternative embodiment of the kayak paddle of the invention is designated 210. Another important ergonomic consideration is the length 230 of the paddle 210. If the paddle 210 is too long or too short, the user may have to compensate for the length by over rotating his shoulders, wrists, and elbows. Because kayak paddles 210 are often shared among many users, the length 230 of the shaft 120 is adjustable to accommodate for the size of different users.

The length 230 of the shaft 220 can be adjusted by providing an adjustment mechanism 231. Such adjustment mechanisms 231 can include but are not limited to a set of telescoping pistons 232, 234. A smaller piston 232 can be positioned inside a larger piston 234 and locked in place by a lock 235. A suitable lock 235 may include a biased pin 236 configured to be positioned in a series of slots 238. By pressing the biased pin 236, a user can slide the smaller piston 232 within the larger piston 234 to shorten or lengthen the shaft 220.

Figure 8:
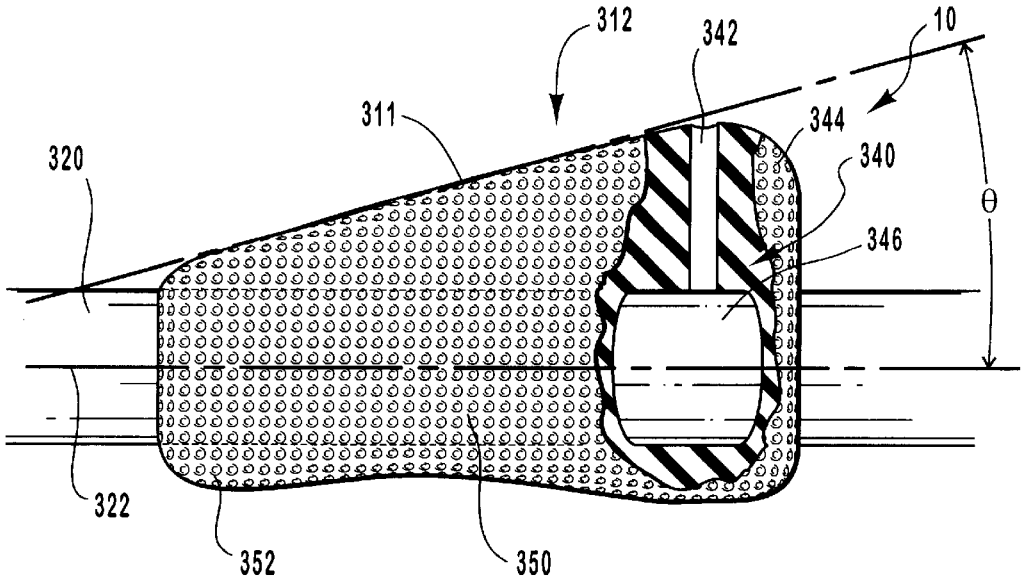
FIG. 8 is a perspective view of one embodiment of a grip of the present invention.

Referring now to FIG. 8, an alternative embodiment of a grip of the present invention is designated 312. Because a paddle 310 may frequently be used by more than one user the grip 312 can be adjusted to fit more than one user. The grip 312 is equipped with an adjuster 340. The adjuster 340 allows the angle of the front surface of the grip 311 to the longitudinal axis 322 of the shaft to be varied to accommodate many users and their preferences. The adjuster 340 can be made to adjust the angle from about 10° to about 30°.

The adjuster 340 of FIG. 8 is formed by positioning one or more set pins 342 within the grip 312. The set pin 342 can be positioned near the high end 344 of the grip 312. The set pin 342 can be tightened to exert a force against the exterior surface 346 of the shaft 320. As the pin 342 presses down against the shaft 320, the high end 344 of the grip 312 is moved away from the shaft 320. This movement increases the angle θ of the front surface 311 of the grip 312 to the longitudinal axis 322. When the pin 342 is loosened, the angle θ is lessened.

The grip 312 can also be texturized to allow a kayaker to hold the paddle 310 without causing undue stress on the kayaker. Because a kayak paddle 310 is used in water, the paddle 310 and grip 310 frequently get wet. When the grip 312 becomes wet, the grip 312 can become slippery. When any handle becomes slippery, a user must exert more force to stabilize the user's grasp of the handle. The grip 312 can be formed from rubber or other material which can withstand water and provide for a secure grip when wet. The exterior surface 350 of the grip 312 can be texturized to prevent the grip 312 from becoming slippery. Such texture may include but is not limited to ribs 352 on the exterior surface 350 of the grip 312. The ribs 352 also provide better blood circulation in the hand while grasping the paddle 310. Textured rubber handles usually provide enough friction for a good grip. However, if the texture is too coarse, skin irritation and reduced grasping efficiency occur. A correctly textured grip 312 allows for retention of the paddle 310 with minimal energy expenditure.

Figure 9:
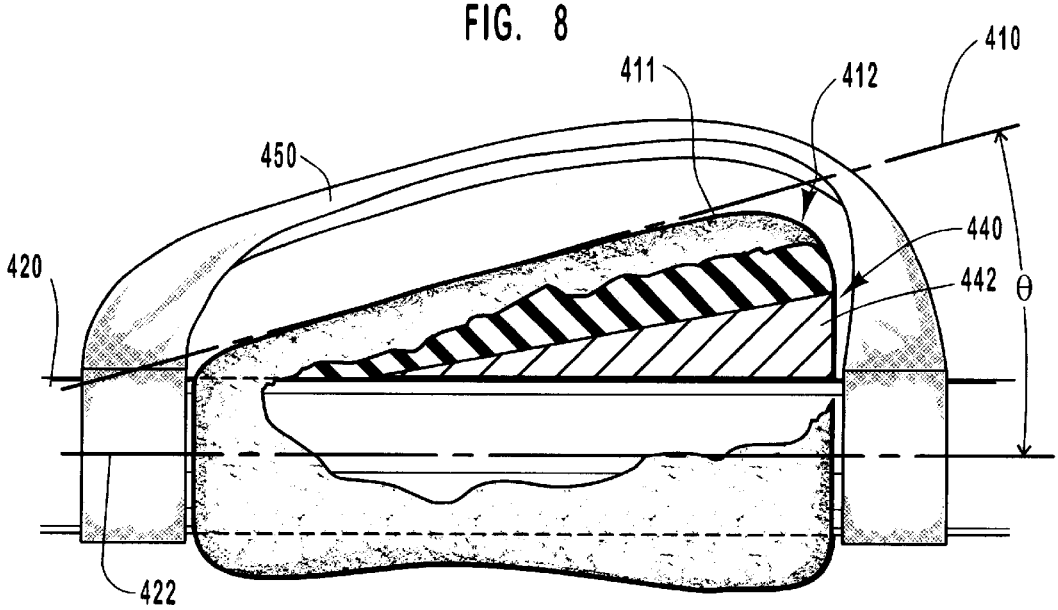
FIG. 9 is a perspective view of an alternative embodiment of the grip of the present invention.
Figure 10:
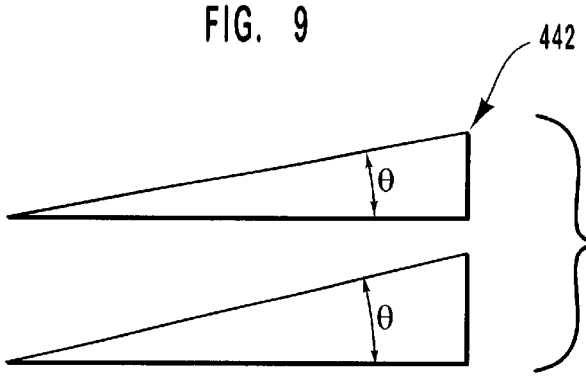
FIG. 10 is a perspective view of alternative shunts for use with the embodiment of FIG. 9.

Referring to FIGS. 9 and 10, a grip with an alternative adjuster 440 is generally designated 412. The adjuster 440 comprises a series of shunts 442 which can be inserted between the grip 412 and the shaft 420. The shunts 442 push the front surface 411 of the grip 412 away from the shaft 420 thereby increasing the angle θ between the longitudinal axis 422 of the shaft 420 and the front surface 411 of the grip 412. Each shunt 342 is generally wedge shaped and has an angle θ. A shunt 442 with a greater angle θ will increase the angle of the front surface 411 of the grip 412 to the axis 422 when compared to a shunt with a lesser angle θ. Because the grip 412 is made of an elastic material such as latex, the grip 412 can stretch and contract to fit the each of the shunts 442.

While kayaking, a kayaker must constantly hold onto the paddle 410 to avoid dropping it into the water. Over time this constant force can result in injury. A handstrap 450 can be provided to reduce the constant forceful grasp on the grip 412. The handstrap 450 can provide a less intense way for a user to hold the paddle encouraging the kayaker to rest, and reduce injury from continued stress. The handstrap 450 may be made from a variety of materials such as leather, nylon, or rubber that can withstand repeated immersion in water. Generally, the handstrap 450 has a strip configuration with a width of more than an inch. A wide strap 450 allows the kayaker, to loosen his grip on the paddle without the strap 450 cutting into the kayaker's hand.

Figure 11:
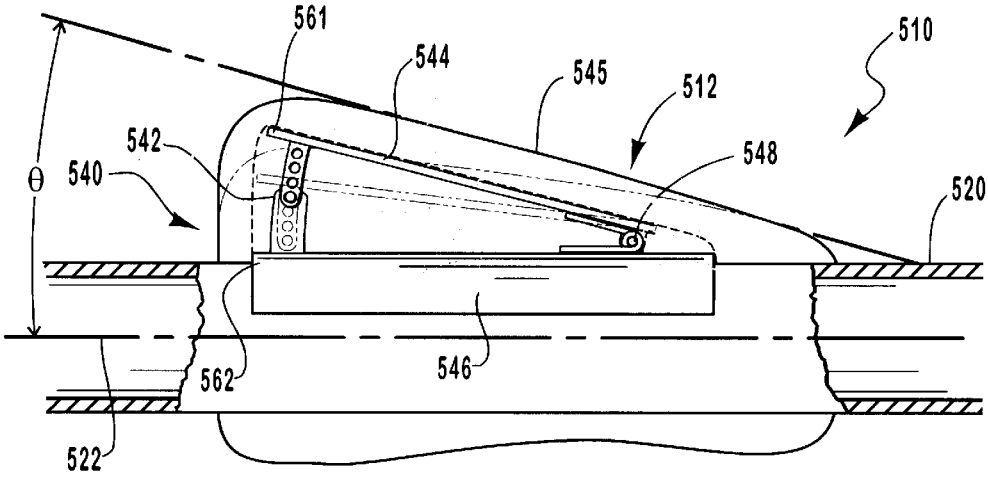
FIG. 11 is a perspective view of an alternative embodiment of the grip of the present invention.

Referring to FIG. 11, another grip with an alternative adjuster 540 is designated 512. The adjuster 540 comprises a ratchet 542 positioned between the shaft 520 of the handle 510. The ratchet 542 comprises an upper support 544 positioned against the interior surface 545 of the grip 512. A lower support 546 is positioned against the shaft 520. The upper and lower supports 544, 546 are connected at a first end by a hinge 548. The angle θ of the front surface of the grip 511 to the longitudinal axis of the shaft can be adjusted by ratcheting the second ends 561, 562 of the supports 544, 546 up or down. As the second ends 561, 562 are racheted up, the angle of the front surface 511 to the longitudinal axis 522 is increased. When the ends 561, 562 are racheted down, the angle of the front surface 511 to the longitudinal axis 522 is decreased.

Figure 12:
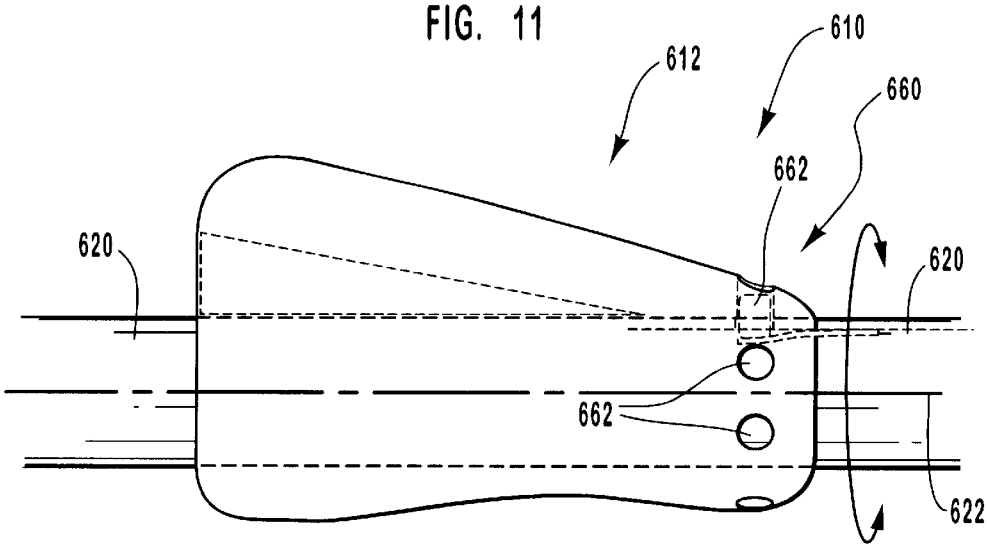
FIG. 12 is a perspective view of an alternative embodiment of the grip of the present invention.

Referring to FIG. 12, an alternative embodiment of the grip of the present invention is designated 612. Another consideration in designing an ergonomic paddle is the relative placement of the hands on the paddle 610. To maintain the position of the hands in an ergonomically correct position, the grips 612 can be attached to the shaft 620 by a releasable attachment mechanism 660 such that the grip may be rotated about the longitudinal axis 622 of the shaft 620. Such releasable attachment mechanisms 660 may include, but are not limited to one or more set screws 662. The screws 662 can be loosened to allow the grip to be rotated about the longitudinal axis 622 in either direction. When the desired position is located, the screw 662 can be tightened securing the grip 612 in place.

Figure 13:
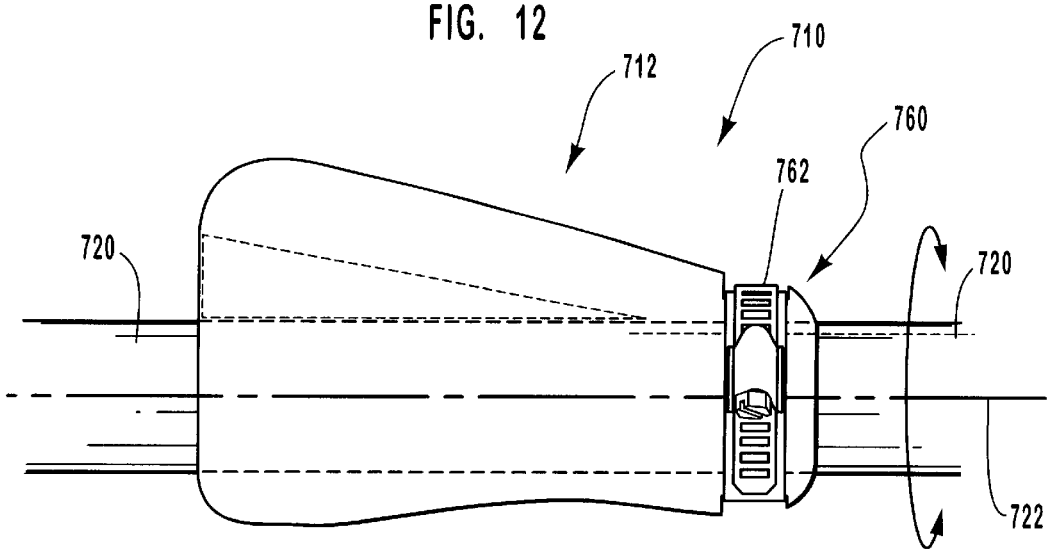
FIG. 13 is a perspective view of an alternative embodiment of the grip of the present invention.

Referring to FIG. 13, an alternative embodiment of the grip of the present invention is designated 712. Another consideration in designing an ergonomic paddle is the relative placement of the hands on the paddle 710. To maintain the position of the hands in an ergonomically correct position, the grips 712 can be attached to the shaft 720 by a releasable attachment mechanism 760 such that the grip may be rotated about the longitudinal axis 722 of the shaft 720. Such releasable attachment mechanisms 760 may include, but are not limited to one or more clamps 762. The clamps 762 can be loosened to allow the grip to be rotated about the longitudinal axis 722 in either direction. When the desired position is located, the clamp 762 can be tightened securing the grip 712 in place.

In summary, the apparatus of the present invention has been developed in response to the present state of the art, and in particular, in response to the problems and needs in the art that have not presently been solved by the currently available kayak paddles. The invention responds to the limitations encountered in existing kayak paddles namely lack of a truly ergonomic kayak paddle. The invention provides a paddle with a grip angled outwardly from the shaft of the paddle. The angled grip allows the user to hold his wrist and forearm in a neutral position while using the paddle. The grip may have a texturized gripping surface to prevent the grip from becoming slippery. Moreover, the angle of the grip to the shaft can be adjusted to accommodate different users. The grip may also be rotated about the longitudinal axis of the paddle to provide for proper positioning of the hands on the paddle. A kayak paddle is also provided with an adjustable shaft to accommodate users of varying sizes. In addition, the a grip may be provided with a hand strap to reduce the stress of constantly holding a paddle.

The present invention may be embodied in other specific forms without departing from its spirit or essential characteristics. The described embodiments are to be considered in all respects only as illustrative and not restrictive. The scope of the invention is therefore, indicated by the appended claims rather than by the foregoing description. All changes which come within the meaning and range of equivalency of the claims are to be embraced within their scope.

What is claimed and desired to be secured by United States Letters Patent is:

1. An ergonomic kayak paddle comprising:

a straight shaft having a longitudinal axis and a first end and a second end;

a first blade and a second blade, the first blade attached to the first end and the second blade attached to the second end; and at least one grip disposed about the shaft at a point intermediate between the first and second ends of the shaft, the grip being angled outwardly from the longitudinal axis of the shaft at an angle ranging from about 10° to about 30°, the angle selected such that when the grip is held in a hand of a user, an imaginary line running through the user's radius in the wrist is approximately parallel to the user's third metacarpal bone.

2. The ergonomic kayak paddle of claim 1, wherein the angle is in the range from about 12° to about 28°.

3. The ergonomic kayak paddle of claim 1, wherein the angle is in the range from about 22° to about 26°.

4. The ergonomic kayak paddle of claim 1, wherein the angle is about 24°.

5. The ergonomic kayak paddle of claim 1, wherein the angle is capable of being adjusted by an adjuster positioned within the at least one grip.

6. The ergonomic kayak paddle of claim 5, wherein the adjuster is a set pin positioned within the grip and against the shaft.

7. The ergonomic kayak paddle of claim 1, wherein the at least one grip is attached to the shaft by a releasable attachment mechanism such that the at least one grip is capable of being rotated about the longitudinal axis of the shaft.

8. The ergonomic kayak paddle of claim 7, wherein the releasable attachment mechanism comprises a set screw.

9. The ergonomic kayak paddle of claim 7, wherein the releasable attachment mechanisms comprises a clamp.

10. The ergonomic kayak paddle of claim 1, wherein the at least one grip is contoured to a user's palm.

11. The ergonomic kayak paddle of claim 1, wherein the at least one grip has a textured gripping surface.

12. The ergonomic kayak paddle of claim 1, wherein the at least one grip is about 10 to about 12 centimeters long.

13. The ergonomic kayak paddle of claim 1, wherein the at least one grip has a diameter that is about 1 cm smaller than a user's inside grip.

14. The ergonomic kayak paddle of claim 1, wherein the shaft has a diameter in the range of from about 0.75 to 1.00 inch.

15. The ergonomic kayak paddle of claim 1, wherein the shaft is adjustable between a first length and a second length.

16. The ergonomic kayak paddle of claim 1, further comprising a hand strap configured to be connected to the shaft.

17. An ergonomic kayak paddle comprising:

a straight shaft having a longitudinal axis and a first end and a second end;

a first blade and a second blade, the first blade attached to the first end and the second blade attached to the second end;

a pair of grips disposed about the shaft at two points intermediate between the first and second ends of the shaft, the grip being angled outwardly from the longitudinal axis of the shaft at an angle ranging from about 10° to about 30°, the angle selected such that when the grip is held in a hand of a user, an imaginary line running through the user's radius in the wrist is approximately parallel to the user's third metacarpal bone; and a gripping surface on the grips, the surface contoured to a user's palm.

18. An ergonomic kayak paddle of claim 17, wherein the angle is in the range from about 12° to about 28°.

19. An ergonomic kayak paddle of claim 17, wherein the angle is in the range from about 22° to about 26°.

20. An ergonomic kayak paddle of claim 17, wherein the angle is about 24°.

21. An ergonomic kayak paddle of claim 17, wherein the grips comprise a textured gripping surface.

22. An ergonomic kayak paddle of claim 17, wherein the grips are about 10 to about 12 centimeters long.

23. The ergonomic kayak paddle of claim 17, wherein the shaft is adjustable between a first length and a second length.

24. By An ergonomic kayak paddle of claim 17, wherein the shaft has a diameter in the range of about 0.75 to 1.00 inch.

25. The ergonomic kayak paddle of claim 17, wherein the grips are attached to the shaft by a releasable attachment mechanism such that the grips are capable of being rotated about the longitudinal axis of the shaft.

26. A kayak paddle comprising:

a straight shaft having a longitudinal axis and having a first end and a second end, the shaft adjustable between a first length and a second length;

a first blade and a second blade, the first blade attached to the first end and the second blade attached to the second end;

a pair of grips disposed about the shaft at two points intermediate between the first and second ends of the shaft, the grips being angled outwardly from the longitudinal axis of the shaft at an angle ranging from about 10° to about 30°, the angle selected such that when the grip is held in a hand of a user, an imaginary line running through the user's radius in the wrist is approximately parallel to the user's third metacarpal bone; and a releasable attachment mechanism for releasably attaching the grips to the shaft, such that the grips are capable of being rotated about the longitudinal axis of the shaft when the releasable attachment mechanism is released.

* * * * *